United States Patent [19]

Jacobsen et al.

[11] 4,391,197

[45] Jul. 5, 1983

[54] SMOKE CARTRIDGE

[75] Inventors: Kjell O. Jacobsen, Raufoss; Gudmund Engen, Jonsvatnet, both of Norway

[73] Assignee: A/S Raufoss Ammunisjonsfabrikker, Raufoss, Norway

[21] Appl. No.: 188,954

[22] Filed: Sep. 19, 1980

Related U.S. Application Data

[63] Continuation of Ser. No. 16,379, Mar. 1, 1979, abandoned.

[30] Foreign Application Priority Data

Mar. 8, 1978 [NO] Norway ..... 780819

[51] Int. Cl.[3] ..... F42B 13/44

[52] U.S. Cl. ..... 102/334; 102/357; 102/367

[58] Field of Search ..... 102/334, 364, 365, 367–370, 102/505, 482–488, 336, 340, 342, 351, 357

[56] References Cited

U.S. PATENT DOCUMENTS

| | | | |
|---|---|---|---|
| 1,366,555 | 1/1921 | Brayton | 102/66 |
| 1,771,455 | 7/1930 | Wiley | 102/66 |
| 3,332,348 | 7/1967 | Myers et al. | 102/90 |
| 3,669,020 | 6/1972 | Waite et al. | 102/90 |
| 3,712,224 | 1/1973 | Hanzel | 102/336 |
| 3,712,225 | 1/1973 | Nimylowycz | 102/432 |
| 3,736,876 | 6/1973 | Little | 102/66 X |
| 4,002,121 | 1/1977 | Prochnow | 102/66 |
| 4,007,690 | 2/1977 | Wildridge | 102/90 |

FOREIGN PATENT DOCUMENTS

| | | | |
|---|---|---|---|
| 1913790 | 6/1973 | Fed. Rep. of Germany . | |
| 2556075 | 6/1976 | Fed. Rep. of Germany | 102/505 |
| 2249590 | 5/1975 | France | 102/90 |
| 1534134 | 11/1978 | United Kingdom . | |

*Primary Examiner*—Harold J. Tudor
*Attorney, Agent, or Firm*—Larson and Taylor

[57] ABSTRACT

A smoke cartridge for producing instantaneous smoke, particularly for screening a vehicle. A casing, preferably made of aluminum, has a first elongated compartment in which a plurality of annular smoke elements are stacked one above the other with a common central opening passing through all of them. A second compartment adjacent the first compartment has a discharge composition therein and a mechanism for igniting the same. When ignited, the discharge composition causes a jet of flames to pass through the central opening between the smoke elements, igniting the latter. A further compartment contains a further discharge composition, preferably ignited after a delay, for propelling the entire casing after the smoke elements have been discharged therefrom.

3 Claims, 1 Drawing Figure

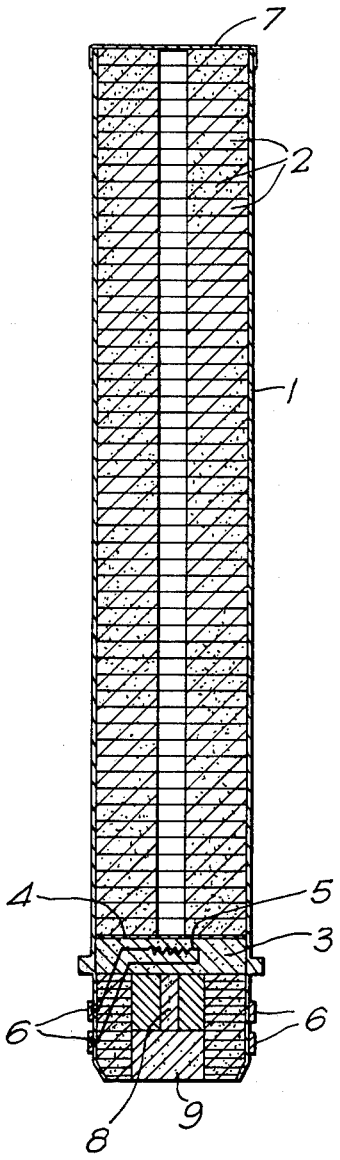
7
2
1
4
5
3
6
6
8
9

SMOKE CARTRIDGE

This is a continuation of application Ser. No. 16,379, filed Mar. 1, 1979, now abandoned.

The present invention relates to a smoke cartridge for vehicle screening, comprising an aluminium casing or another suitable casing which is filled by smoke charge elements and a discharge composition which is separated from said smoke charge elements.

In combat in a modern battlefield it is of the greatest importance to be able to screen ones own vehicles against enemy fire. This can be achieved in various manners. Screening of vehicles by smoke screening is a most important measure.

A vehicle under enemy fire needs smoke screening with an instantaneous effect to get out of it.

Smoke can be generated in the desired area in various manner. Such a smoke screening method e.g. comprises the use of smoke charges. Smoke charges can be discharged and ignited in the area to be screened.

Thus, a device for the ignition of a smoke or flame generating composition is known from the West German Pat. No. 1,913,790. Said Specification describes a smoke grenade with reference to FIGS. 1 and 2. Said smoke grenade is fired by the aid of the discharge composition and is filled with smoke charge elements which can be ignited by the aid of the primer composition at a desired moment after firing. Furthermore, discharge and bursting charges are arranged in the pressure chamber to set off the ignited smoke and flame charge elements like small shot from the grenade as indicated in FIG. 3. In FIG. 6 of said Specification another embodiment is shown. This is a smoke cartridge, where the smoke charge elements are not sent to such hights as is typical of the smoke grenade. Also in this case a primer composition is ignited in an ignition tube which in turn ignites the smoke elements and the discharge composition arranged in the pressure chamber. By pressure force on the washer the charge is thrown out together with an easily releasable cover and the smoke elements are dispersed.

The present invention is characterized in that the smoke charge elements have the shape of annular disc shaped elements like cylindrical superimposed pineapple slices having an open hole in the middle for ignition by a jet of flame from the discharge composition. In marked contrast to the previously mentioned smoke cartridge for vehicle screening there is no ignition charge within said open hole. The discharge composition in this case functions both as a discharge composition and as an ignition charge for the smoke elements. When the smoke cartridge is thrown out by ignition of the discharge composition a film that is arranged between said discharge composition and the smoke elements is disrupted by a jet of flame spurting through the open hole in the pineapple slice shaped smoke elements. The jet of flame will simultaneously ignite said smoke elements and throw them apart and thus cause the desired dispersion. Combustion of the smoke elements and the concurrent smoke generation is, thus, spread over a very large area as desired and offers an effective smoke screening of vehicles with an immediate effect.

This structure differs from the previously mentioned smoke elements in that the structure is simplified because the ignition charge is omitted. Obviously, this makes the production of the smoke elements simpler and less expensive. Also, the smoke elements are shaped as whole pineapple slices, whereas the smoke elements of the above mentioned West German Patent as shown in FIG. 5 have a more divided and more complicated shape. This means that there is a simplification according to the present invention which in turn simplifies production and makes it less expensive.

The smoke cartridge according to the present invention is used in a system which as to velocity is essentially unsurpassable by other systems.

The ignition of the discharge composition which also has the effect of an ignition charge for the pineapple slice shaped smoke elements is achieved electrically via the the firing tube from a triggering panel in the vehicle.

The ignited smoke elements are fired from said tube with a very large velocity. Thus, the immediate advantage is achieved that the established smoke screen covers a large area and that the smoke screen is established immediately. From each tube a conical smoke screen is provided. With an angle of 45° between each of 5 tubes a dense smoke screen covering more than 180° is achieved.

The smoke cartridge can comprise a delay element which immediately after the smoke screen has been established will ignite a discharge composition for that portion of the cartridge that remains in the firing tube. Said firing tube is, thus, ready for reloading immediately after firing.

The effect of this smoke system is that smoke is established over a large area immediately. Thus, the enemy fire, which may consist of wire-guided missiles, gunfire and other weapons which need free visibility, is reduced to a fraction.

The single FIGURE is a longitudinal cross-sectional view through a smoke cartridge made in accordance with the present invention.

The invention is illustrated with reference to the drawing, disclosing a sectional view of a smoke cartridge for vehicle screening according to the invention. An aluminium shell 1 with a cover 7 encompasses pineapple slice shaped smoke elements 2, that are stacked on top of each other and, thus, form a cylinder having a void in the middle. Said cylinder also contains a discharge composition 3 for the smoke elements, which is ignited by an electrical igniter 5 receiving power from a battery operatively connected to said contact rings 6. The discharge composition 3 is separated from the smoke elements 2 by an aluminium sheet 4. When the discharge composition 3 is ignited a delay element 8 is simultaneously ignited. Said delay element in turn ignites a second discharge composition 9 which sends the entire empty smoke cartridge off from the fire tube.

We claim:

1. A smoke cartridge for producing instantaneous smoke, comprising:

a casing, a first compartment within said casing comprising a stack of annular disc shaped smoke elements piled one on top of the other, and a hole passing longitudinally through each smoke element such that the holes through all of the smoke elements form a central passageway passing longitudinally of the casing through the entire first compartment, the forward end of the casing having a releasable cover, at least some of the smoke producing material of every smoke element being directly exposed to the central passageway, the smoke elements being free of connection to each other, such that immediately upon leaving the casing, each smoke element is separate from the other smoke elements, a second compartment separated axially from the first compartment and axially adjacent the rearward end of the first compartment and containing a discharge composition and a means for igniting the discharge composition, said discharge composition comprising substantially the complete ignition composition for igniting all the disc shaped smoke elements, such that upon ignition of the discharge compositon a jet of flames passes into one end of and then through the passageway to ignite all of the smoke elements directly exposed thereto as this same discharge composition expels all of the smoke elements out of the casing, whereupon, immediately upon discharge, each smoke element is free to scatter independently of the other smoke elements, a third compartment adjacent the second compartment on the side thereof opposite the first compartment, a second discharge composition in said third compartment for propelling the casing itself, and including a delay means between the second and third compartment such that ignition of the second discharge composition is delayed until after the smoke elements have been discharged from the first compartment.

2. A smoke cartridge according to claim 1, said casing being made of aluminum.

3. A smoke cartridge according to claim 1 or claim 2, each said annular smoke element having flat end faces, such that the stack comprises such smoke elements stacked with their flat faces against each other.

* * * * *